US011511453B1

(12) United States Patent
Poltorak

(10) Patent No.: US 11,511,453 B1
(45) Date of Patent: Nov. 29, 2022

(54) SPOT WELD REMOVAL PUNCH

(71) Applicant: Pawel A. Poltorak, LaPorte, TX (US)

(72) Inventor: Pawel A. Poltorak, LaPorte, TX (US)

( * ) Notice: Subject to any disclaimer, the term of this patent is extended or adjusted under 35 U.S.C. 154(b) by 200 days.

(21) Appl. No.: 16/911,495

(22) Filed: Jun. 25, 2020

Related U.S. Application Data

(60) Provisional application No. 62/925,894, filed on Oct. 25, 2019.

(51) Int. Cl.
*B26F 1/14* (2006.01)
*B21D 28/34* (2006.01)

(52) U.S. Cl.
CPC ..... *B26F 1/14* (2013.01); *B21D 28/34* (2013.01)

(58) Field of Classification Search
CPC ..... B25D 5/00; B25D 5/02
See application file for complete search history.

(56) References Cited

U.S. PATENT DOCUMENTS 797,824 A * 8/1905 Sietz ..... B25D 5/00 30/367
1,572,046 A * 2/1926 Seiler ..... B25D 5/02 81/463
3,177,952 A * 4/1965 West ..... B25D 5/00 173/124
3,180,018 A * 4/1965 Hougen ..... B23B 51/0453 408/1 R
4,012,161 A * 3/1977 Shultz ..... B23D 79/021 408/112
4,644,656 A * 2/1987 Chouinard ..... B25D 9/00 30/362
4,735,528 A * 4/1988 Parrone ..... B23B 49/005 408/112
5,349,737 A 9/1994 Long
7,284,332 B2 * 10/2007 Long ..... B25D 5/00 30/360
8,141,458 B1 * 3/2012 Spencer ..... B25D 1/00 81/20
9,206,577 B2 * 12/2015 Lusk ..... E02D 7/04
2018/0056494 A1 * 3/2018 Echasserieau ..... B25D 5/02

FOREIGN PATENT DOCUMENTS

BE 857696 A * 12/1977 ..... B25D 5/00
CN 101903136 A * 12/2010 ..... B25B 21/02
DE 19711334 A1 * 9/1998 ..... B21D 39/00

* cited by examiner

*Primary Examiner* — Jennifer S Matthews
(74) *Attorney, Agent, or Firm* — Donald J. Ersler

(57) ABSTRACT

A spot weld removal punch preferably includes a punch body, a centering pin, a venting roll pin and a compression spring. The punch body preferably includes a punch shank, a body portion and a punch flange. The punch shank extends from one end of the punch flange and the body portion extends from an opposing end of the punch flange. A pin bore is formed in the end of the body portion to receive the centering pin and the compression spring. The venting roll pin is transversely inserted into the pin bore to retain the centering pin. A second embodiment of a spot weld removal punch preferably includes a punch body, a centering pin, a pin retention device, a replaceable impact head and a compression spring. The replaceable impact head may be replaced when thereof wears out.

20 Claims, 6 Drawing Sheets

SPOT WELD REMOVAL PUNCH

CROSS-REFERENCE TO RELATED APPLICATIONS

This a nonprovisional patent application, which claims the benefit of provisional patent application No. 62/925,894 filed on Oct. 25, 2019.

BACKGROUND OF THE INVENTION

Field of the Invention

The present invention relates generally to vehicle sheet metal panels and more specifically to a spot weld removal punch, which enables two pieces of sheet metal joined by a spot weld to be separated without damaging the two pieces of sheet metal.

Discussion of the Prior Art

Repairing automobiles frequently requires removing sheet metal panels, which are spot welded to each other. The spot welds are typically removed by drilling the spot welds to separate the two sheet metal panels. However, drilling the spot welds can damage drills after only a dozen or less spot welds or damage the underlying metal if done improperly. U.S. Pat. No. 5,349,737 to Long discloses a method for separating spot-welded sheet metal parts.

Accordingly, there is a clearly felt need in the art for a spot weld removal punch, which enables two pieces of sheet metal joined by a spot weld to be separated without damaging the two pieces of sheet metal.

SUMMARY OF THE INVENTION

The present invention provides a spot weld removal punch, which enables two pieces of sheet metal joined by a spot weld to be separated from each other. The spot weld removal punch preferably includes a punch body, a centering pin, a venting roll pin and a compression spring. The punch body preferably includes a punch shank, a body portion and a punch flange. The punch shank extends from one end of the punch flange and the body portion extends from an opposing end of the punch flange. An impact end of the body portion includes an outer chamfer and an inner chamfer. A pin bore is formed in the end of the body portion to receive the centering pin and the compression spring. An axis of a roll pin hole is formed through pin bore and perpendicular to an axis of the pin bore. The roll pin hole is sized to receive the venting roll pin. The centering pin preferably includes a pin shaft and a pin base. The pin shaft extends from the pin base. A centering point is preferably formed on an end of the pin shaft. A pin slot is formed in an end of the venting roll pin to receive an outer perimeter of the pin shaft. The spot weld removal punch is assembled by inserting the compression spring into the pin bore and then inserting the centering pin. The centering pin is pushed into the pin bore, such that the compression spring is compressed. The venting roll pin is then pressed into the roll pin hole.

A second embodiment of a spot weld removal punch preferably includes a punch body, a centering pin, a pin retention device, a replaceable impact head and a compression spring. The punch body preferably includes a punch shank, a body portion and a punch flange. The punch shank extends from one end of the punch flange and the body portion extends from an opposing end of the punch flange.

A pin bore is formed in an end of the body portion to receive the centering pin and the compression spring. A reduced diameter is formed on an end of the body portion. The reduced diameter is threaded to threadably receive the replaceable impact head. The centering pin preferably includes a pin shaft and a pin flange. The pin shaft extends from the pin flange. A centering point is preferably formed on an end of the pin shaft. The pin retention device is preferably a set screw with a lengthwise bore, which is sized to receive the pin shaft. The pin retention device is threaded into an entrance of the pin bore. The replaceable impact head preferably includes a retention bore. An exit of the retention bore is threadedably engaged with the reduced diameter. A radial vent hole is formed through a wall of the replaceable impact head to communicate with the retention bore. An outer chamfer is formed on an impact end of the replacement impact head and an inner chamfer is formed on an entrance of the lengthwise retention bore. The second embodiment of the spot weld removal punch is assembled by inserting the compression spring into the pin bore and then inserting the centering pin. The centering pin is pushed into the pin bore, such that the compression spring is compressed. The pin retention device is threaded into the pin bore. The replaceable impact head is threaded on to the reduced diameter.

In use, the shank portion is retained in a chuck of an impact gun (impact wrench). Each spot weld is center punched or drilled to form a concave dimple, but not drilled through the spot weld. The centering point is inserted into the concave dimple. It may be necessary to place a hammering dolly behind the spot weld. The impact gun is actuated, until a slug of material is displaced from the spot weld by repeated hammering of the impact end. The slug of material may be removed with a cutting tool, such as a chisel or any other appropriate tool.

Accordingly, it is an object of the present invention to provide a spot weld removal punch, which enables two pieces of sheet metal joined by a spot weld to be separated without damaging the two pieces of sheet metal.

These and additional objects, advantages, features and benefits of the present invention will become apparent from the following specification.

DETAILED DESCRIPTION OF THE PREFERRED EMBODIMENTS

Figures 1, 2:
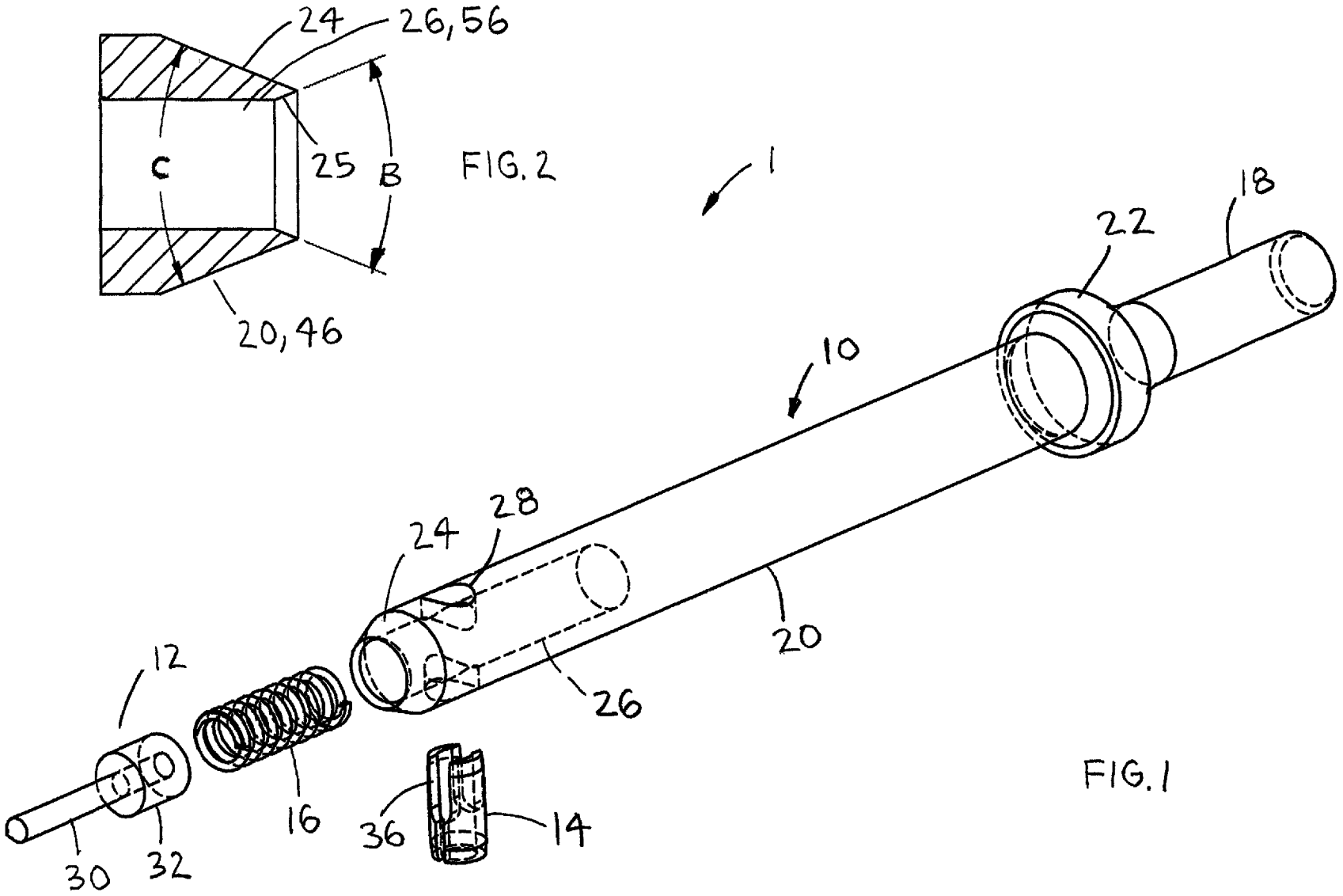
FIG. 1 is an exploded perspective view of a spot weld removal punch in accordance with the present invention.
FIG. 2 is an enlarged cross sectional view of an impact end of a spot weld removal punch in accordance with the present invention.
Figure 3:
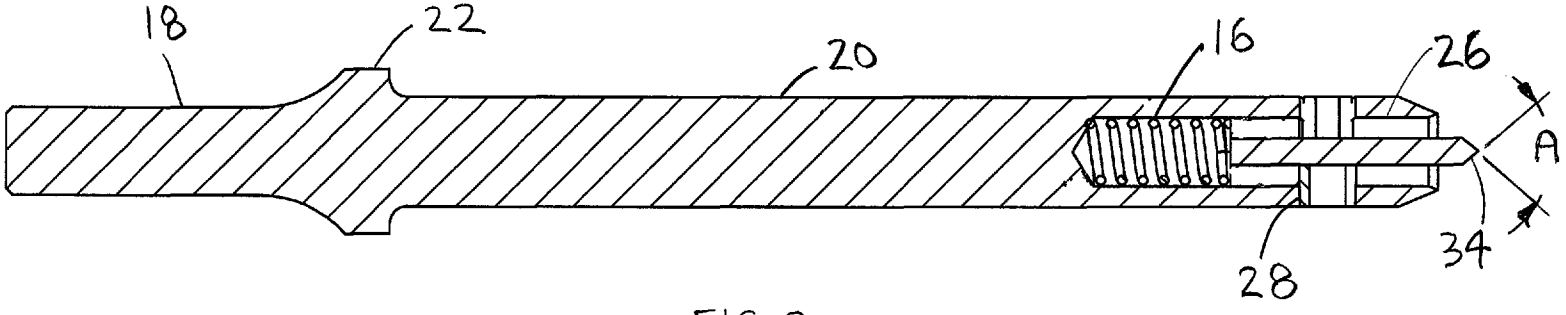
FIG. 3 is a cross sectional view of a spot weld removal punch in accordance with the present invention.
Figure 4:
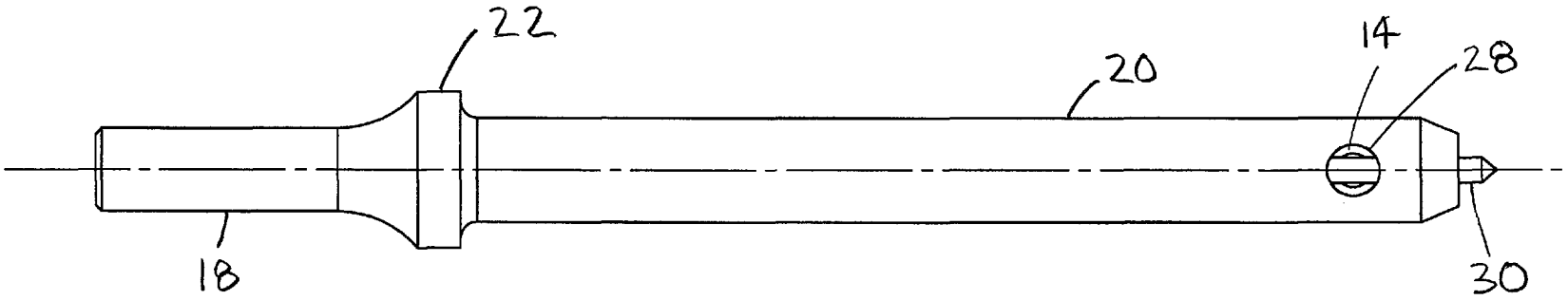
FIG. 4 is a top view of a spot weld removal punch in accordance with the present invention.
Figure 5:
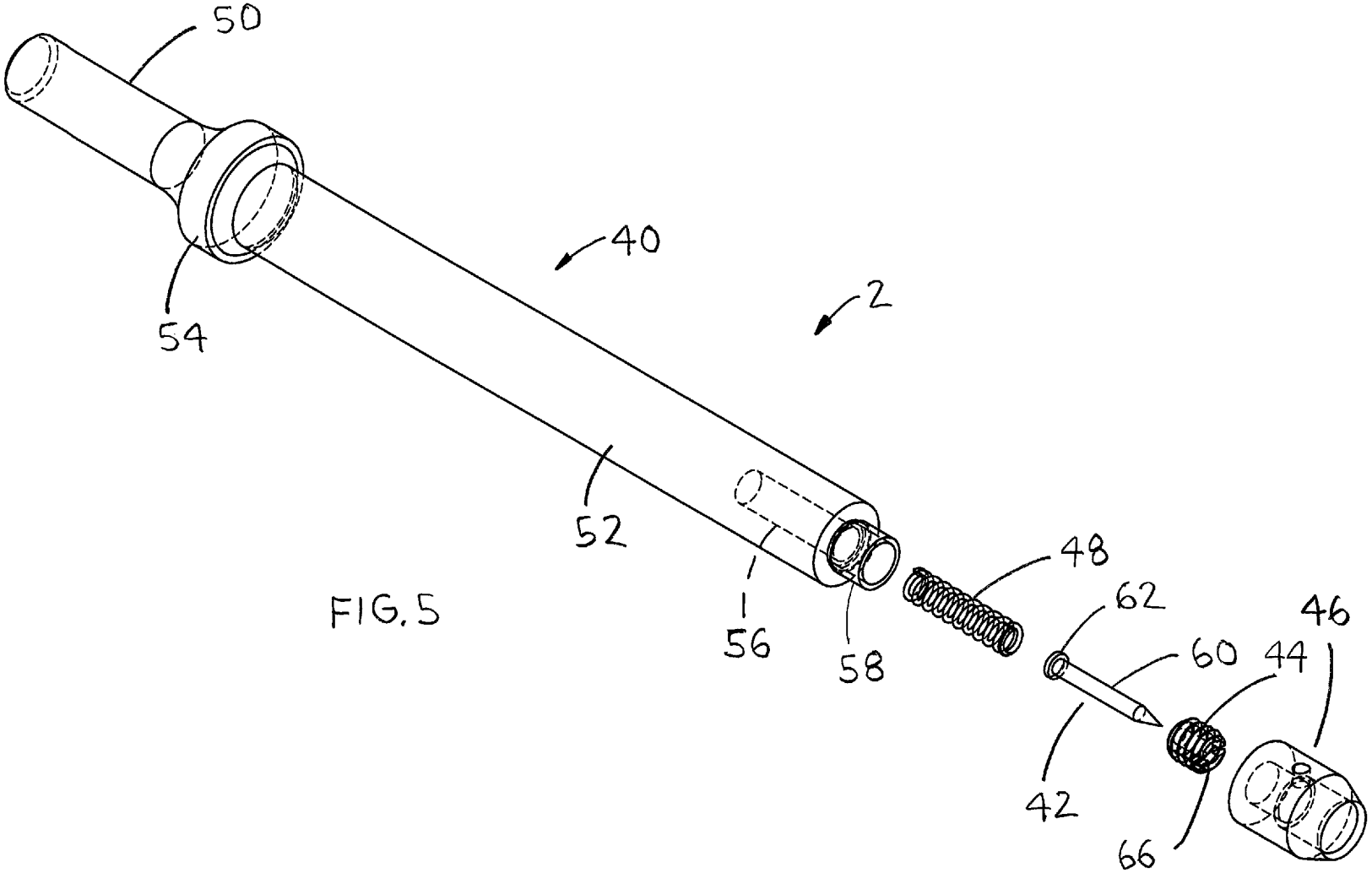
FIG. 5 is an exploded perspective view of a second embodiment of a spot weld removal punch in accordance with the present invention.
Figure 6:
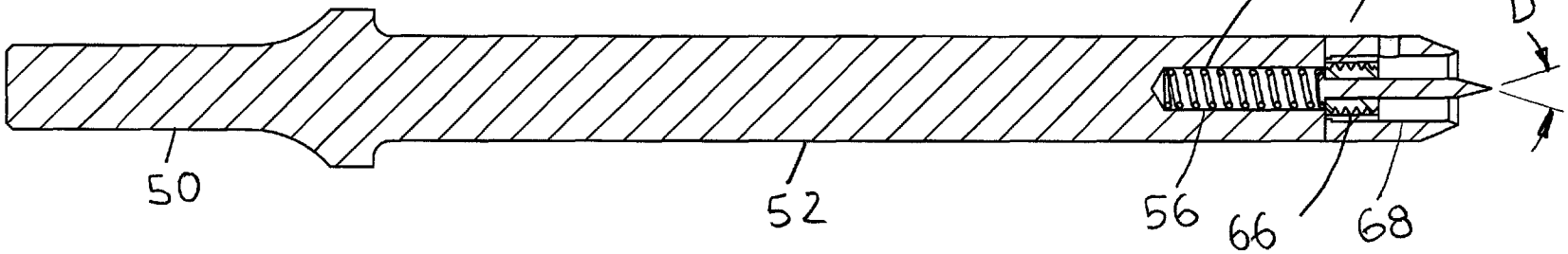
FIG. 6 is a cross sectional view of a second embodiment of a spot weld removal punch in accordance with the present invention.
Figure 7:
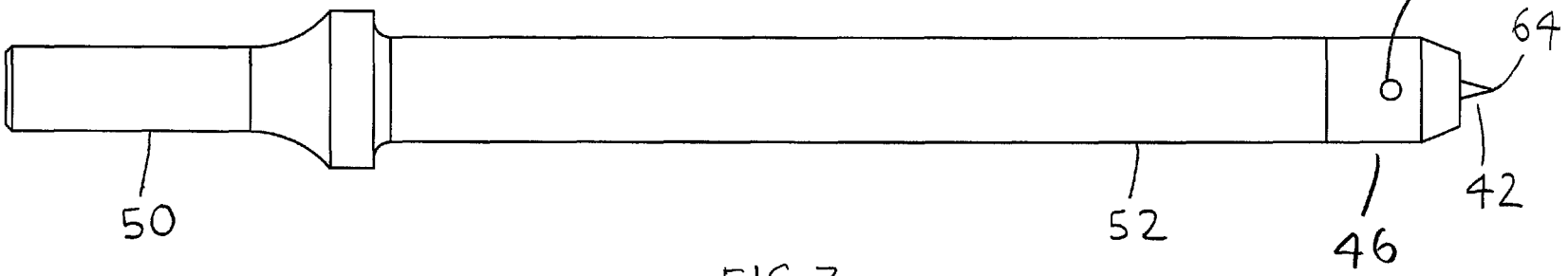
FIG. 7 is a top view of a spot weld removal punch in accordance with the present invention.

With reference now to the drawings, and particularly to FIG. 1, there is shown a perspective view of a spot weld removal punch 1. With reference to FIGS. 3-4, the spot weld removal punch 1 preferably includes a punch body 10, a centering pin 12, a venting roll pin 14 and a compression spring 16. The punch body 10 preferably includes a punch shank 18, a body portion 20 and a punch flange 22. The punch shank 18 extends from one end of the punch flange 22 and the body portion 20 extends from an opposing end of the punch flange 22. With reference to FIG. 2, an impact end of the body portion 20 preferably includes an outer chamfer 24 and an inner chamfer 25. An included angle "B" of the inner chamfer 25 is preferably 45 degrees, but other values may also be used. An included angle "C" of the outer chamfer 24 is preferably 45 degrees, but other values may also be used. The inner and outer chamfers 24, 25 form a circular knife edge.

A pin bore 26 is formed in the end of the body portion 20 to receive the centering pin 12 and the compression spring 16. The compression spring 16 may be replaced with any suitable biasing device. An axis of the roll pin hole 28 is formed through the pin bore 26 and perpendicular to an axis of the pin bore 26. The axis of the roll pin 28 preferably intersects the axis of the pin bore 26. The roll pin hole 28 is sized to receive the venting roll pin 14. However, venting roll pin 14 could also be characterized as a retention plug. An inner perimeter of the venting roll pin 14 allows compressed air to escape the pin bore 26 to prevent damage to the body portion 20. The centering pin 12 preferably includes a pin shaft 30 and a pin base 32. The pin shaft 30 extends from the pin base 32. A centering point 34 is preferably formed on an end of the pin shaft 30. The centering pin 12 may be fabricated from a single piece of material or, from two pieces of material. The pin shaft 30 could be pressed into a hole in the pin base 32. An angle "A" of the centering point is preferably 80 degrees, but other angles may also be used. A pin slot 36 is formed in an end of the venting roll pin 14 to receive an outer perimeter of the pin shaft 30.

The spot weld removal punch 1 is assembled by inserting the compression spring 16 into pin bore and then inserting the centering pin. The centering pin 12 is pushed into the pin bore 26, such that the compression spring 16 is compressed. Finally, the venting roll pin 14 is pushed into the roll pin hole 28 to preload the centering pin 12 with the compression spring 16.

A second embodiment of a spot weld removal punch 2 preferably includes a punch body 40, a centering pin 42, a pin retention device 44, a replaceable impact head 46 and a compression spring 48. The punch body 40 preferably includes a punch shank 50, a body portion 52 and a punch flange 54. The punch shank 50 extends from one end of the punch flange 54 and the body portion 52 extends from an opposing end of the punch flange 54. A pin bore 56 is formed in an impact end of the body portion 52 to receive the centering pin 42 and the compression spring 48. A reduced diameter 58 is formed on the impact end of the body portion 52. The reduced diameter 58 is threaded on an outside diameter to threadably receive the replaceable impact head 46. The centering pin 42 preferably includes a pin shaft 60 and a pin flange 62. The pin shaft 60 extends from the pin flange 62. A centering point 64 is preferably formed on an end of the pin shaft 42. An angle "D" of the centering point 64 is preferably 80 degrees, but other angles may also be used. The pin retention device 44 is preferably a set screw with a lengthwise bore 66, which is sized to receive the pin shaft 60.

The pin retention device 44 is threaded into an entrance of the pin bore 56. The replaceable impact head 46 preferably includes a retention bore 68. An exit of the lengthwise retention bore 68 is threadably engaged with an outer diameter of the reduced diameter. A radial vent hole 70 is formed through a wall of the replaceable impact head 46 to communicate with the lengthwise retention bore 68. The lengthwise retention bore 68 must be vented. Actual use has shown that compressed air (because of a lack of venting) in the lengthwise retention bore 68 has a negative effect on the performance of the spot weld removal punch 2.

With reference to FIG. 2, an outer chamfer 24 is formed on an impact end of the replacement impact head 46 and an inner chamfer 25 is formed on an entrance of the lengthwise retention bore 68. The spot weld removal punch 2 is assembled by inserting the compression spring 48 into the pin bore 56 and then inserting the centering pin 42. The centering pin 42 is pushed into the pin bore 56, such that the compression spring 48 is compressed. The pin retention device 44 is threaded into the pin bore 56. The replaceable impact head 46 is threaded on to the reduced diameter 58.

Figure 8:
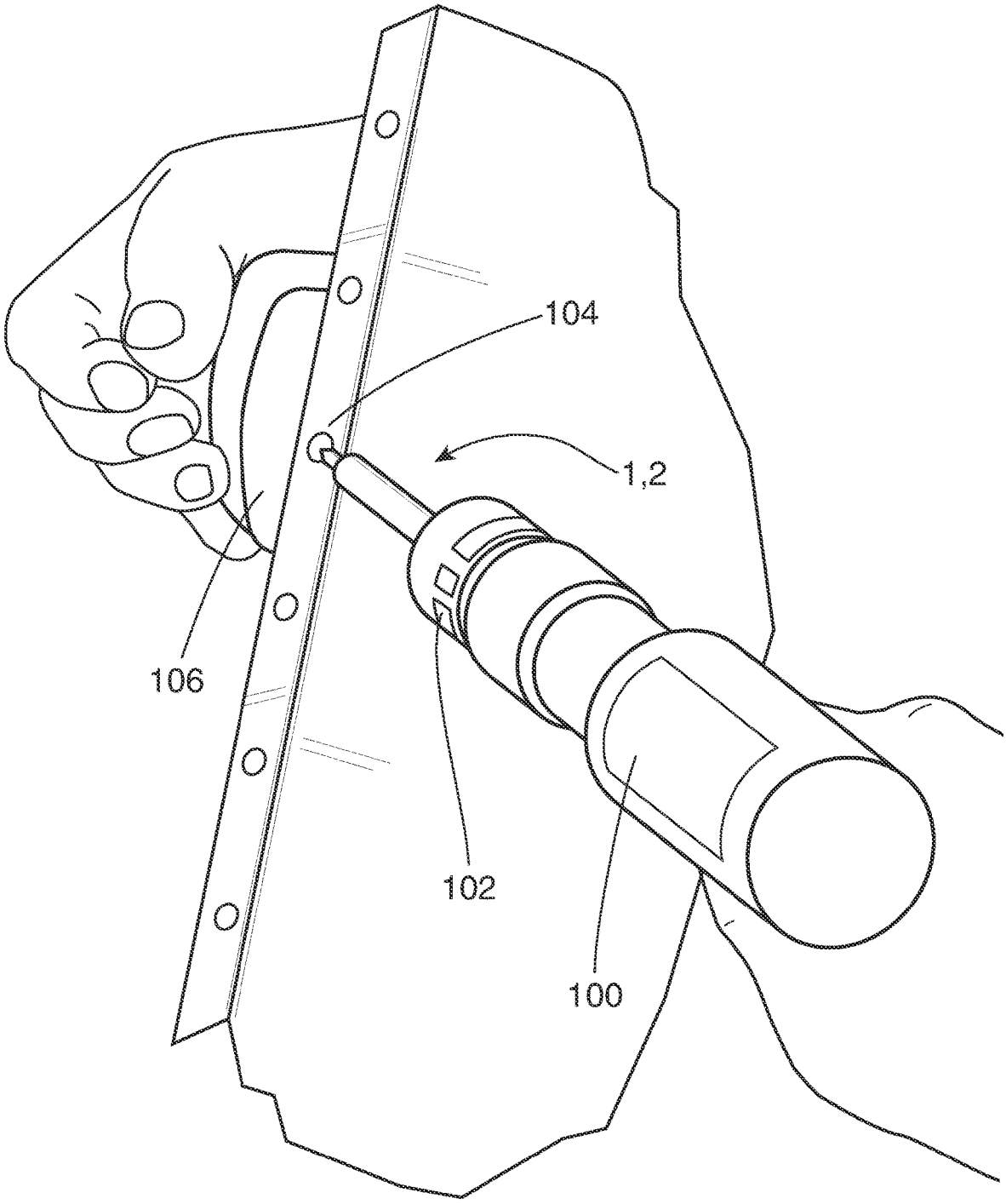
FIG. 8 is a perspective view of a spot weld removal punch retained in an impact gun in accordance with the present invention.
Figure 9:
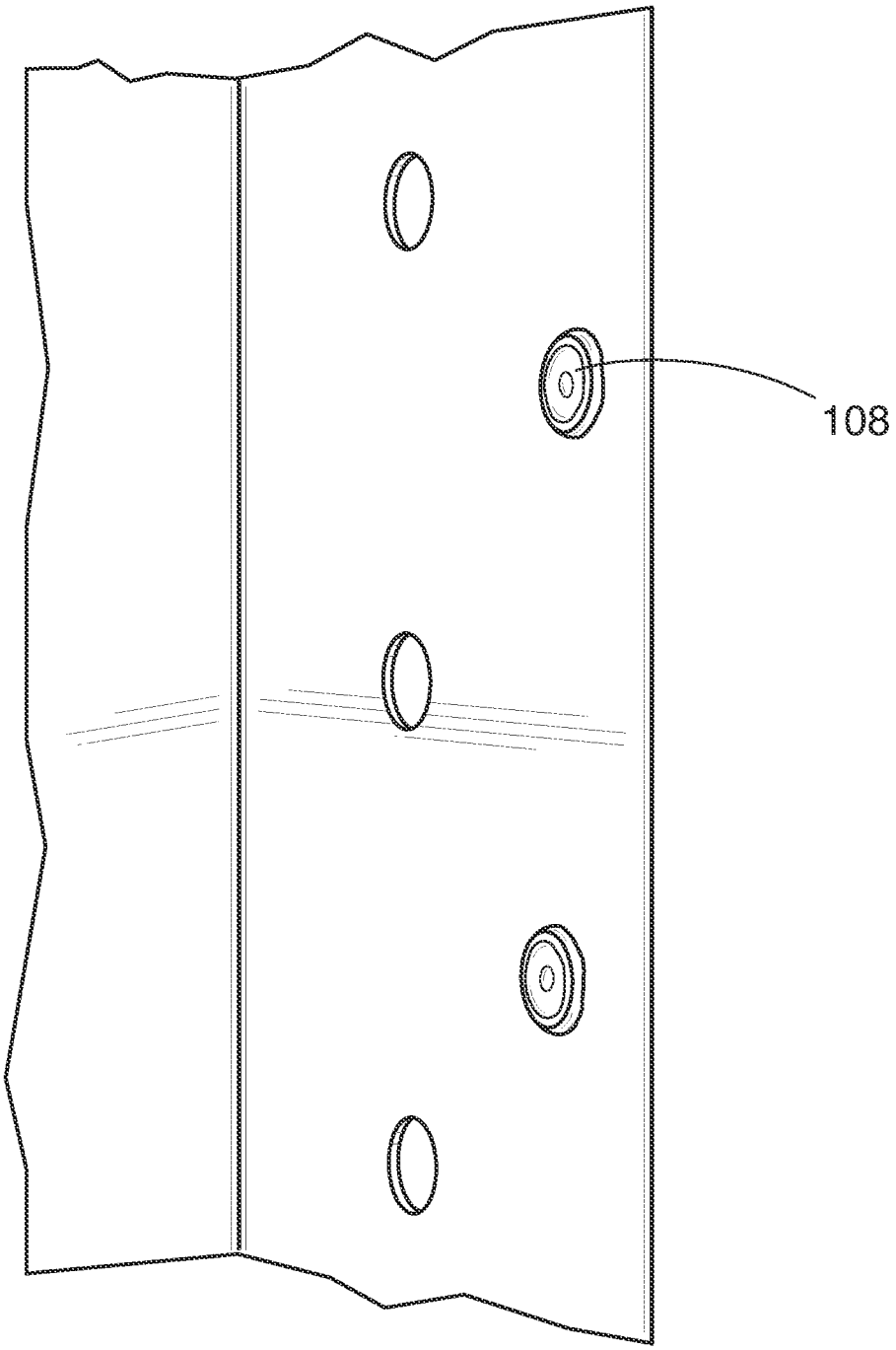
FIG. 9 is an enlarged perspective view of a plurality of spot welds after application of a spot weld removal punch thereto in accordance with the present invention.

With reference to FIG. 8, the shank portion 18, 50 is retained in a chuck 102 of an impact gun (impact wrench) 100. First, each spot weld 104 is center punched or drilled to form a concave dimple, but not drill through the spot weld. The centering point 34, 64 is inserted into the concave dimple of the spot weld 104. It may be necessary to place a hammering dolly 106 behind the spot weld. With reference to FIG. 9, the impact gun 100 is actuated, until a slug of material 108 is displaced from the spot weld 104 by repeated hammering of the impact end. The slug of material 108 may be removed with a cutting tool, such as a chisel or any other suitable tool.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A spot weld removal punch comprising:

a punch body includes a pin bore formed in an impact end, a roll pin hole is formed through opposing sides of said punch body to intersect said pin bore;

a centering pin includes a pin shaft and a pin base, said pin shaft extends from said pin base;

a venting roll pin includes an inner perimeter and a pin slot formed in an end thereof to receive said pin shaft, said venting roll pin is sized to be received by said roll pin hole; and a compression spring is sized to be received by said pin bore, wherein said centering pin is inserted into said pin bore such that said pin base is retained behind said venting roll pin, said inner perimeter is configured to allow air to escape said pin bore when said pin base is pushed inward, said impact end has a knife edge to cut the spot weld.

2. The spot weld removal punch of claim 1 wherein:

said punch body includes a punch shank, a body portion and a punch flange, said punch shank extends from one end of said punch flange, said body portion extends from an opposing end of said punch flange.

3. The spot weld removal punch of claim 1 wherein:

an outer chamfer is formed on an outer diameter of said impact end of said punch body, an inner chamfer is formed in said pin bore of said punch body.

4. The spot weld removal punch of claim 1 wherein:

said spot weld removal punch is used in an impact gun.

5. The spot weld removal punch of claim 1 wherein:

a centering point is formed on an end of said centering pin.

6. The spot weld removal punch of claim 1 wherein:

said pin bore extends less than one half a length of said punch body.

7. The spot weld removal punch of claim 1 wherein:

said centering pin extends less than one half a length of said punch body.

8. The spot weld removal punch of claim 1 wherein:

said pin shaft extends through an entire length of said pin base.

9. The spot weld removal punch of claim 1 wherein: said roll pin includes a slit formed through a side wall thereof.

10. A spot weld removal punch for retention in a chuck of an impact wrench, comprising:

a punch body includes a pin bore formed in an impact end, a roll pin hole is formed through opposing sides of said punch body to intersect said pin bore, said punch body is configured to be received by the chuck of the impact wrench;

a centering pin includes a pin shaft and a pin base, said pin shaft extends from said pin base;

a venting roll pin includes an inner perimeter and a pin slot formed in an end thereof to receive said pin shaft, said venting roll pin is sized to be received by said roll pin hole; and a compression spring is sized to be received by said pin bore, wherein said centering pin is inserted into said pin bore such that said pin base is retained behind said venting roll pin, said inner perimeter is configured to allow air to escape said pin bore when said pin base is pushed inward.

11. A spot weld removal punch for retention in a chuck of an impact wrench of claim 10 wherein:

said pin bore extends less than one half a length of said punch body.

12. A spot weld removal punch for retention in a chuck of an impact wrench of claim 10 wherein:

said centering pin extends less than one half a length of said punch body.

13. A spot weld removal punch for retention in a chuck of an impact wrench of claim 10 wherein:

said pin shaft extends through an entire length of said pin base.

14. A spot weld removal punch for retention in a chuck of an impact wrench of claim 10 wherein: said roll pin includes a slit formed through a side wall thereof.

15. A spot weld removal punch comprising:

a punch body includes a pin bore formed in an impact end, a roll pin hole is formed through opposing sides of said punch body to intersect said pin bore, a circular knife edge is formed on said impact end of said punch body;

a centering pin includes a pin shaft and a pin base, said pin shaft extends from said pin base;

a venting roll pin includes an inner perimeter and a pin slot formed in an end thereof to receive said pin shaft, said venting roll pin is sized to be received by said roll pin hole; and a compression spring is sized to be received by said pin bore, wherein said centering pin is inserted into said pin bore such that said pin base is retained behind said venting roll pin, said inner perimeter is configured to allow air to escape said pin bore when said pin base is pushed inward, said knife edge cuts the spot weld.

16. The spot weld removal punch of claim 15 wherein:

said pin bore extends less than one half a length of said punch body.

17. The spot weld removal punch of claim 15 wherein:

said centering pin extends less than one half a length of said punch body.

18. The spot weld removal punch of claim 15 wherein:

said pin shaft extends through an entire length of said pin base.

19. The spot weld removal punch of claim 15 wherein: said roll pin includes a slit formed through a side wall thereof.

20. The spot weld removal punch of claim 15 wherein:

an outer chamfer is formed on said one end of said punch body to form said knife edge.

* * * * *